US005573556A

United States Patent [19]

Wen

[11] Patent Number: 5,573,556

[45] Date of Patent: Nov. 12, 1996

[54] CONVERSION OF SOLID CARBONACEOUS MATERIAL USING POLYOXOANIONS

[75] Inventor: Michael Y. Wen, Baton Rouge, La.

[73] Assignee: Exxon Research And Engineering Company, Florham Park, N.J.

[21] Appl. No.: 333,811

[22] Filed: Nov. 3, 1994

[51] Int. Cl.[6] ..... C10L 1/02; C10G 1/00

[52] U.S. Cl. ..... 44/620; 44/622; 208/415; 208/419; 208/420; 208/421; 208/435

[58] Field of Search ..... 44/620, 622; 208/415, 208/419, 420, 421, 435

[56] References Cited

U.S. PATENT DOCUMENTS

| | | | |
|---|---|---|---|
| 4,111,787 | 9/1978 | Aldridge et al. | 208/421 |
| 4,196,072 | 1/1980 | Aldridge et al. | 208/421 |
| 5,015,366 | 5/1991 | Ruether et al. | 208/435 |
| 5,256,278 | 10/1993 | Rindt et al. | 44/620 |
| 5,294,349 | 3/1994 | Kramer et al. | 208/420 |
| 5,338,441 | 8/1994 | LeViness et al. | 208/421 |
| 5,389,230 | 2/1995 | Veluswamy | 208/420 |

*Primary Examiner*—Jacqueline V. Howard
*Attorney, Agent, or Firm*—Henry E. Naylor

[57] ABSTRACT

A process for the conversion of solid carbonaceous materials, such as coal, to liquid products using one or more polyoxoanions selected from those represented by:

$[(C_nH_{2n+1})_4N]_aM_bO_cH_d$, where n=1 to 8, a=2 to 6, b=2 to 12, c=7 and M is a metal selected from Groups VB and VIB of the Periodic Table of the Elements.

7 Claims, 1 Drawing Sheet

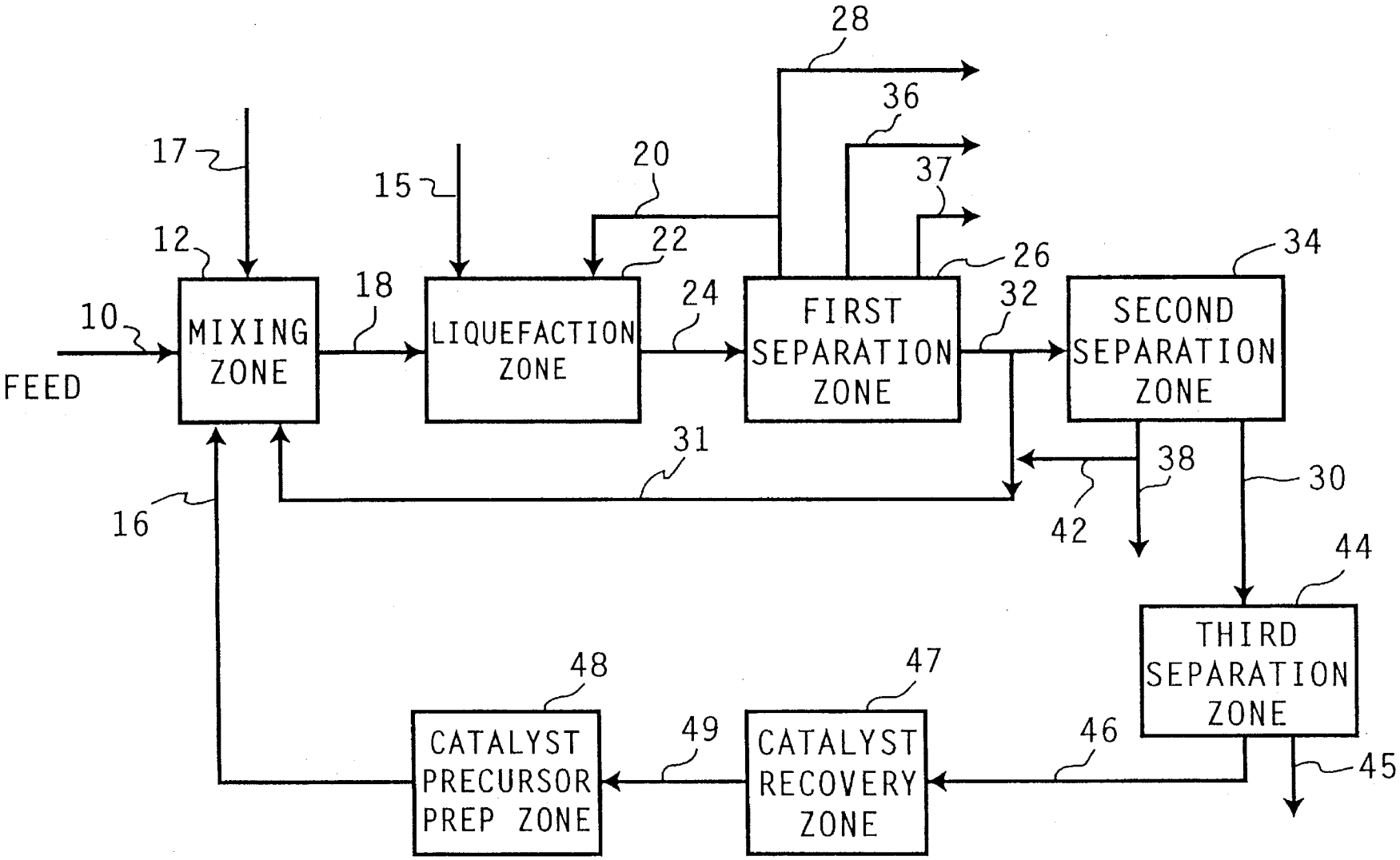
FEED
10
12
MIXING ZONE
17
15
18
LIQUEFACTION ZONE
20
22
24
FIRST SEPARATION ZONE
28
36
37
26
32
SECOND SEPARATION ZONE
34
38
42
30
31
THIRD SEPARATION ZONE
44
45
46
CATALYST RECOVERY ZONE
47
49
CATALYST PRECURSOR PREP ZONE
48
16

CONVERSION OF SOLID CARBONACEOUS MATERIAL USING POLYOXOANIONS

FIELD OF THE INVENTION

The present invention relates to the conversion of solid carbonaceous materials, such as coal, to liquid products using one or more polyoxoanions selected from those represented by:

$[(C_nH_{2n+1})_4N]_aM_bO_cH_d$, where n=1 to 8, a=2 to 6, b=2 to 12, c=7 to 48, and d=0 to 3, and M is a metal selected from Groups VB and VIB of the Periodic Table of the Elements.

BACKGROUND OF THE INVENTION

Much work has been done over the years on processes for obtaining liquid products from solid carbonaceous materials such as coal. Coal liquefaction is such a process and is primarily a thermal process wherein retrogressive reactions occur in the early stages that have an adverse effect of efficiency. It has been found that such retrogressive reactions can be reduced by use of various catalysts, such as transition metal sulfides. Various metal catalyst precursors have been used which decompose at elevated temperatures and react with sulfur-containing compounds to form the corresponding metal sulfides. Typical catalyst precursors include inorganic salts and heteropoly acids, such as phosphomolybdic acid. These catalyst precursors, which are usually in the form of an aqueous solution are introduced into the coal by conventional techniques, such as by impregnation or by blending it into a recycle stream. Either way, drying and activation steps must be employed.

Another type of precursor is the oil soluble type which has the advantage of direct addition into the coal slurry. The primary disadvantage of conventional oil soluble precursors are their relatively high costs and low metals content.

Consequently, there still exists a need in the art for improved coal liquefaction processes which have the advantage of oil soluble catalyst precursors, but without their disadvantages.

SUMMARY OF THE INVENTION

In accordance with the present invention, there is provided a process for enhancing the conversion of a naturally occurring solid carbonaceous material to normally liquid products, which process comprises:

(a) forming a slurry comprised of naturally occurring solid carbonaceous material, a hydrocarbonaceous solvent, a sulfur-containing compound, and at least one catalyst precursor represented by the formula: $[(C_nH_{2n+1})_4N]_aM_bO_cH_d$, where n=1 to 8, a=2 to 6, b=2 to 12, c=7 to 48, and d=0 to 3, and M is a metal selected from Groups VB and VIB of the Periodic Table of the Elements;

(b) heating said slurry at an effective temperature and pressure to convert the catalyst precursor to the corresponding catalyst; and (c) introducing said slurry into a liquefaction zone maintained at a temperature from about 340° to 510° C. and a pressure from about 300 to 3000 psig wherein at least a portion of said carbonaceous material is converted to normally liquid products.

In a preferred embodiment of the present invention the carbonaceous material is coal.

In another preferred embodiment the metal is molybdenum.

BRIEF DESCRIPTION OF THE FIGURES

The sole FIGURE hereof is a schematic flow diagram of a process within the scope of the present invention. The elements of the process are referenced numerically in the Detailed Description of the Invention.

DETAILED DESCRIPTION OF THE INVENTION

The present invention relates to an improved process for enhancing the conversion of a naturally occurring solid carbonaceous material, such as coal, to a liquid product. Solid carbonaceous material on which the present invention can be practiced include coal, coke, peat, wood and similar solid carbonaceous materials containing a relatively high ratio of carbon to hydrogen. Preferred is coal, non-limiting examples of which include anthracite, bituminous coal, sub-bituminous coal, and lignite, as well as mixtures thereof. The present process involves co-feeding a sulfur-containing compound with a slurry of solid carbonaceous material and a hydrocarbonaceous solvent into at least one liquefaction zone. It is preferred that the solid carbonaceous material be partially liquefied. That is, it is preferred that the bottoms material of the instant process be recycled to the liquefaction zone from a first separation zone. It may contain some gas oil or other solvents. The bottoms material may also be introduced from an outside source, however. It may be introduced into any one or all of the stages. Further, the liquefaction may be accomplished in a single stage or in a plurality of stages with catalyst present in all stages.

It is preferred that the solid carbonaceous material be ground to a finely divided state. The particular particle size employed is not critical, but it is preferred that the particle size be less than about ¼ inch, more preferably less than about 8 mesh (NBS sieve size).

Catalyst precursors suitable for use herein are those represented by the formula:

$[(C_nH_{2n+1})_4N]_aM_bO_cH_d$, where n=1 to 8, a=2 to 6, b=2 to 12, c=7 to 48, and d=0 to 3, and M is a metal selected from Groups VB and VIB of the Periodic Table of the Elements. The Periodic Table referred to herein can be found on the inside front cover of Handbook of Chemistry and Physics, 69th Edition, 1988–1989, Published by CRC Press. The preferred Group VB metal is V. Preferred Group VIB metals are Mo and W, more preferred is Mo.

The FIGURE hereof shows one embodiment of the present invention wherein one liquefaction zone is employed. The solid carbonaceous material is fed to mixing zone 12 via line 10. The catalyst precursor via line 16, as well as a sulfur-containing compound via line 17, are also fed into mixing zone 12. Solvent and bottoms produced in the process are recycled via line 31 to mixing zone 12. The solvent will typically be a gas oil having a boiling range of about 340° C. to 540° C. It is preferred that the ratio of solvent to solid carbonaceous material (on a moisture-free basis) be about 0.8:1 to 4:1 on a weight basis. Ratios in the higher portion of this range are required at higher bottoms recycle rates to ensure that the slurry can be transported by pumping or similar means. More preferred is that only a sufficient amount of solvent needed to maintain a pumpable viscosity be recycled. The catalyst precursor will be added so that the concentration will be within the range of about 20 to 3,000 wppm, based on active metal, by weight of dry solid carbonaceous material, such that the concentration in the liquefaction vessel will be within the range of about 30 to 20,000 wppm based on total solids. The precise amount of catalyst precursor used will depend on such things as the amount of bottoms recycled. When multiple liquefaction stages are employed, the catalyst concentration in any particular stage may vary due to different amounts of bottoms recycled to the different stages. The catalyst concentration within any given stage will be within the aforementioned range of from about 30 to about 20,000 wppm.

Solvents useful in the practice of the present invention include any of the solvents, or diluents, known in the art to be useful for the liquefaction of solid carbonaceous materials, particularly coal. The solvent requirements of the present process will typically be fully satisfied by the product stream itself. For example, a product stream fraction boiling in the gas oil range having an initial boiling point of about 340° C. and a final boiling point of about 540° C. is preferred as the solvent herein. Other suitable solvents include non-hydrogen donor solvents, preferably those which contain less than about 0.8 wt. % donatable hydrogen, based on the weight of the solid carbonaceous material. More preferably, the solvent will be a compound, or mixture of compounds, having an atmospheric boiling point ranging from about 175° C. to about 450° C., most preferably from about 175° C. to about 340° C. Non-limiting examples of suitable solvents include aromatic compounds such as alkylbenzenes, alkylnaphthalenes, alkylated polycyclics, heteroaromatics, and mixtures thereof. Also suitable are streams such as unhydrogenated creosote oil, intermediate product streams from fluid catalytic cracking of petroleum feedstocks, coal derived liquids, shale oil and the like.

The sulfur compound used herein is preferably introduced in readily releasable forms. Non-limiting examples include $H_2S$, elemental sulfur, and sulfur-containing hydrocarbons. Use of elemental sulfur is generally preferred for low toxicity, low cost, and ease of handling purposes. Elemental sulfur, either as the sublimed powder or as a concentrated dispersion, such as commercial flowers of sulfur, in heavy hydrocarbonaceous oil, is introduced into mixing zone 12 via line 17. Allotropic forms of elemental sulfur, such as orthorhomic and monoclinic sulfur, are also suitable for use herein. The preferred physical form of sulfur is the sublimed powder (flowers of sulfur), although sulfur may also be introduced as molten sulfur, or as sulfur vapor. The amount of sulfur used herein is such that the atomic ratio of sulfur to metal in the catalyst precursor is from about 1/1 to 8/1, preferably from about 2/1 to 7/1, and more preferably from about 3/1 to 6/1.

The resulting slurry from mixing zone 12 is fed via line 18 to liquefaction zone 22. If the liquefaction is to be done in a plurality of stages, a series of two or more liquefaction vessels may be arranged in series and operated so that the temperature in each vessel, or zone, increases progressively from the initial stage to the final stage. The effluent from each liquefaction stage is passed to the next succeeding higher temperature stage. Liquid hydrocarbonaceous products are recovered from the effluent withdrawn from the final stage. At each stage, the liquefaction effluent may be separated into a vaporous stream and a liquid stream, the liquid stream consisting of a low molecular weight liquid fraction and a higher molecular weight liquid fraction. Hydrogen is fed into said liquefaction zone via line 15. This hydrogen, which is considered make-up hydrogen, is used to meet the hydrogen requirements of the liquefaction zone, along with recycle hydrogen which is introduced the liquefaction zone from first separation zone 26 via line 20. The liquefaction zone is operated at a temperature from about 340° C. to about 510° C., preferably from about 400° C. to about 460° C., and at a pressure from about 300 to 3000 psig, preferably from about 1500 to 2500 psig. This pressure includes hydrogen partial pressures, as well as pressures from light gases such as propane, $H_2S$, and $CO_2$, and light liquids such as recycle solvent, naphtha, and distillates. The total nominal residence time of all liquefaction stages will generally range from about 25 to 250 minutes.

The effluent from liquefaction zone 22 is fed into first separation zone 26 via line 24 wherein lighter products such as gases, naphtha, and distillate are removed overhead via lines 28, 36, and 37 respectively. This first separation zone will typically be run at substantially atmospheric pressure. A bottoms, or high boiling fraction of the effluent from said first separation zone, is recycled to mixing zone 12 via line 31. The remaining effluent is sent to second separation zone 34 via line 32 wherein it is fractionated into a gas oil fraction which is collected via line 38 and a bottoms fraction which is passed to third separation zone 44. A portion of the gas oil is recycled to the liquefaction zone via line 42. The bottoms fraction is collected via line 45 for disposal or further use or processing. Spent catalyst is separated from the bottoms fraction in third separation zone 44 and sent to catalyst recovery zone 47 via line 46. The catalyst recovery zone is operated at temperatures from about 1400° to about 1800° C. in the presence of air wherein the spent catalyst (molybdenum sulfides) are oxidized and sublimated to $MoO_3$, in the case where the metal is molybdenum. The treated spent catalyst is passed from catalyst recovery zone 47 to catalyst precursor preparation zone 48 via line 49 wherein HCl, ammonia, and a tetraalkylammonium halide are introduced (not shown). The preferred halide is chlorine. At least a stoichiometric amount of HCl and ammonia are added, based on the amount of catalytic metal. The resulting regenerated catalyst precursor is then recycled to mixing zone 12.

The following examples are presented to illustrate the present invention and are not to be taken as limiting in any way.

EXAMPLE 1

50.0 g of sodium molybdate dihydrate, $Na_2MoO_4 \cdot 2H_2O$ (99% purity), were dissolved in 107 g of distilled water (solution 1) in a 1000 ml glass reactor equipped with stirrer. 34.6 g of 36.5 wt. % HCl diluted with 13.8 g of distilled water were then added to acidify the solution 1. Solution 2 was prepared by dissolving 22.2 g of tetrabutylammonium bromide (99% purity) in 37 g of distilled water. After adding solution 2 to solution 1 at room temperature with agitation, a white precipitate immediately formed. The glass reactor was then heated in a hot water bath to 80°–85° C. and maintained at that temperature for 45 minutes. The white precipitate turned yellow after this heat treatment. The yellow precipitate was then filtered on 10–15 μm filter and washed several times with distilled water to remove salts, such as sodium chloride and sodium bromide. The washed yellow precipitate was dried in an oven at 49° C. for 12–24 hours. 45.6 g of tetrabutylammonium hexamolybdate, $[(C_4H_9)_4N]_2Mo_6O_{19}$, were obtained. The yield was 98% on molybdenum basis. The molybdenum content of tetrabutylammonium hexamolybdate is 42.2 wt. %. Recrystallization of tetrabutylammonium hexamolybdate was done by mixing the dried material with 600 ml of hot acetone on a hot plate, then evaporating the acetone in a vacuum oven under nitrogen at 49° C.

EXAMPLE 2

75 g of sodium molybdate dihydrate, $Na_2MoO_4 \cdot 2H_2O$ (99% purity), were dissolved in 310 g of distilled water (solution 1) in a 100-ml glass reactor equipped with stirrer. 89.7 g of 6N HCl were then added to acidify the solution 1. Solution 2 was prepared by dissolving 33.4 g of tetrabutylammonium bromide (99% purity) in 60.7 g of distilled water. After adding solution 2 to solution 1 at room temperature with agitation, a white precipitate immediately formed. The reactor was heated for 45 minutes and the resulting yellow precipitate was filtered, washed, and dried as in Example 1. 67.0 g of tetrabuytlammonium hexamolybdate, $[(C_4H_9)_4N]_2Mo_6O_{19}$, were obtained. The yield was 96.0 wt. % on molybdenum basis.

EXAMPLE 3

A first solution (solution 1) was prepared by dissolving 50.0 g of sodium molybdate dihydrate, $Na_2MoO_4 \cdot 2H_2O$ (99% purity), in 206.6 g of distilled water in a 1000 ml glass reactor equipped with stirrer and 60.2 g of 6N HCl was added to acidify. A second solution (solution 2) was prepared by diluting 21.9 grams of a 75% methyltributyl-ammonium bromide solution with 21.9 g of distilled water. After adding the second solution to the first solution at room temperature with agitation, a white precipitate immediately formed. The reactor was heated for 60 minutes and the resulting yellow precipitate was filtered, washed, and dried as in Example 1.40 g of methyltributylammonium hexamolybdate, $[CH_3(C_4H_9)_3N]_2Mo_6O_{19}$, were obtained. The yield was 91.0 wt. % on molybdenum basis.

EXAMPLE 4

50.0 g of sodium molybdate dihydrate, $Na_2MoO_4 \cdot 2H_2O$ (99% purity), were dissolved in 206.6 g of distilled water (solution 1) in a 1000 ml glass reactor equipped with stirrer. 60.2 g of 6N HCl were then added to acidify the solution 1. Solution 2 was prepared by dissolving 14.6 g of tetraethylammonium bromide in 26.5 g of distilled water. After adding solution 2 to solution 1 at room temperature with agitation, a white precipitate immediately formed. The reactor was heated for 30 minutes and the resulting yellow precipitate was filtered, washed, and dried as in example 1 above. 25.2 g of tetrabutylammonium hexamolybdate, $[(C_2H_5)_4N]_2Mo_6O_{19}$, were obtained. The yield was 64.0 wt. % on molybdenum basis.

EXAMPLE 5

The experiment of Example 4 was repeated except the heat treatment time at 80°–85° C. was extended to 60 minutes. The amount of dried tetraethylammonium hexamolybdade was 27.9 g. The yield was 71.0 wt. % on molybdenum basis.

EXAMPLE 6

50.0 g of sodium molybdate dihydrate, $Na_2MoO_4 \cdot 2H_2O$ (99% purity), were dissolved in 206.6 g. of distilled water (solution 1) in a 1000 ml glass reactor equipped with stirrer. 60.2 g. of 6N HCl were then added to acidify the solution 1. Solution 2 was prepared by dissolving 10.6 g. of methyltriethylammonium bromide in 19.2 g. of distilled water. After adding solution 2 to solution 1 at room temperature with agitation, a white precipitate formed immediately. The reactor was heated for 120 minutes and the resulting yellow precipitate was filtered, washed, and dried as in Example 1 above. 20.5 g. of methyltriethylammonium hexamolybdate, $[CH_3(C_4H_5)_3N]_2Mo_6O_{19}$, were obtained. The yield was 54.0 wt. % on molybdenum basis.

EXAMPLE 7

50.0 g of sodium molybdate dihydrate, $Na_2MoO_4 \cdot 2H_2O$ (99% purity), were dissolved in 206.6 g of distilled water (solution 1) in a 1000 ml glass reactor equipped with stirrer. 60.2 g of 6N HCl were then added to acidify the solution 1. Solution 2 was prepared by dissolving 14.6 g of tetramethylammonium bromide in 26.5 g of distilled water. After adding solution 2 to solution 1 at room temperature with agitation, a white precipitate formed immediately. The reactor was heated for 60 minutes and the resulting yellow precipitate was filtered, washed, and dried as in Example 1 above. 21.5 g of dried mixture of tetramethylammonium dimolybdate, $[(CH_4)_4N]_2Mo_2O_7$, tetramethylammonium hexamolybdate, $[(CH_4)_4N]_2Mo_6O_{19}$, and tetramethylammonium octamolybdate, $[(CH_4)N]_4Mo_8O_{26}$, were obtained

EXAMPLE 8

50.0 g of ammonium heptamolybdate tetrahydrate, $(NH_4)_6Mo_7O_{24} \cdot 4H_2O$ (ACS grade), were dissolved in 283.2 g of distilled water (solution 1) in a 1000 ml glass reactor equipped with stirrer. 25.9 g of 6N HCl were then added to acidify the solution 1. Solution 2 was prepared by dissolving 30.7 g of tetrabutylammonium bromide in 55.9 g of distilled water. After adding solution 2 to solution 1 at room temperature with agitation, a white precipitate immediately formed. The reactor was heated for 60 minutes and the resulting yellow precipitate was filtered, washed, and dried as in Example 1 above. 63.6 g of tetrabuytlammonium hexamolybdate, $[(C_4H_9)_4N]_2Mo_6O_{19}$, were obtained. The yield was 98.8 wt. % on molybdenum basis.

EXAMPLE 9

50.0 g of ammonium heptamolybdate tetrahydrate, $(NH_4)_6Mo_7O_{24} \cdot 4H_2O$ (ACS grade), were dissolved in 283.2 g of distilled water (solution 1) in a 1000 ml glass reactor equipped with stirrer. 25.9 g of 6N HCl were diluted with 17.3 g of distillated water and then added to the solution 1. Solution 2 was a 37 wt. % tetraethylammonium chloride aqueous solution. After adding 42.7 g of solution 2 to solution 1 at room temperature with agitation, a white precipitate immediately formed. The glass reactor was then heated in a hot water bath to 85°–90° C. and stayed at the temperature for 60 minutes. The white precipitate turned yellow after the heat treatment. The yellow precipitate was then filtered on 10–15 μm filter and washed several times with distilled water to remove ammonium chloride. The washed yellow precipitate was dried in an oven at 49° C. for 12–24 hours. 51.6 g of tetraethylammonium hexamolybdate were obtained. The yield was 95.9 wt. % on molybdenum basis. The molybdenum content of tetraethylammonium hexamolybdate is 50.5 wt. %.

EXAMPLE 10

100.0 g. of ammonium heptamolybdate tetrahydrate, $(NH_4)_6Mo_7O_{24} \cdot 4H_2O$ (ACS grade), were dissolved in 396.5 g of distilled water (solution 1) in a 1000 ml glass reactor equipped with stirrer. 51.9 g of 6N HCl were diluted with 25.9 g of distillated water and then added to the solution 1. Solution 2 was a 37 wt. % tetraethylammonium chloride aqueous solution. After adding 86.2 g of solution 2 to solution 1 at room temperature with agitation, a white precipitate formed immediately The glass reactor was then heated in a hot water bath to 90°–95° C. and stayed at the temperature for 120 minutes. The white precipitate turned yellow after the heat treatment. The yellow precipitates were then filtered on 10–15 μm filter and washed several times with distilled water to remove ammonium chloride. The washed yellow precipitate was dried in an oven at 49° C. for 12–24 hours. 104.9 g of tetraethylammonium hexamolybdate were obtained. The yield was 97.5 wt. % on molybdenum basis.

EXAMPLE 11

50.0 g. of ammonium heptamolybdate tetrahydrate, $(NH_4)_6Mo_7O_{24}\cdot 4H_2O$ (ACS grade), were dissolved in 283.2 g of distilled water (solution 1) in a 1000 ml glass reactor equipped with stirrer. 25.9 g of 6N HCl were added to the solution 1. Solution 2 was prepared by dissolving 14.6 g of methyltriethylammonium chloride in 26.6 g of distilled water. After adding the solution 2 to solution 1 at room temperature with agitation, a white precipitate immediately formed. The glass reactor was then heated in a hot water bath to 80°–85° C. and stayed at the temperature for 120 minutes. The white precipitate turned yellow after the heat treatment. The yellow precipitate was then filtered on 10–15 μm filter and washed several times with distilled water to remove ammonium chloride. The washed yellow precipitate was dried in an oven at 120° F. for 12–24 hours. 47.4 g of methyltriethylammonium hexamolybdate were obtained. The yield was 90.3 wt. % on molybdenum basis.

EXAMPLE 12

50.0 g of ammonium heptamolybdate tetrahydrate, $(NH_4)_6Mo_7O_{24}\cdot 4H_2O$ (ACS grade), were dissolved in 283.2 g of distilled water (solution 1) in a 1000 ml glass reactor equipped with stirrer. 25.9 g of 6N HCl were added to the solution 1. Solution 2 was prepared by dissolving 10.5 g of tetramethylammonium chloride in 19.0 g of distilled water. After adding the solution 2 to solution 1 at room temperature with agitation, a white precipitate immediately formed. The glass reactor was then heated up in a hot water bath to 80°–85° C. and stayed at the temperature for 120 minutes. The white precipitate turned yellow after the heat treatment. The yellow precipitate was then filtered on 10–15 μm filter and washed several times with distilled water to remove ammonium chloride. The washed yellow precipitate was dried in an oven at 49° C. for 12–24 hours. 44.1 g of dried mixture of tetramethylammonium dimolybdate, tetramethylammonium hexamolybdate, and tetramethylammonium octamolybdate were obtained.

EXAMPLE 13

The thermal stability of tetrabutylammonium hexamolybdate was tested in a DuPont 2000 Thermal Gravimetric Analyzer. Both hydrogen and inert gas were used to conduct the test. Tetrabutylammonium hexamolybdate showed remarkable stability below 315° C. under both hydrogen and inert gas, no weight loss was observed. It decomposed quickly around 332° C. and lost all of its alkylammonium ligand.

EXAMPLE 14

The thermal stability of tetraethylammonium hexamolybdate was tested in a DuPont 2000 Thermal Gravimetric Analyzer. Nitrogen gas was used to conduct the test. Tetraethylammonium hexamolybdate showed remarkable stability below 315° C., no weight loss was observed. It decomposed quickly around 343° C. and lost all of its alkyl ammonium ligand.

EXAMPLE 15

Hydroconversion of Ohio coal was carried out in a 380 ml autoclave. 40 g of coal and 60 g of process derived solvent were fed to the autoclave. Different forms of molybdenum precursors in the amount (Mo metal basis) of 1.0 wt. % of dry coal were tested to compare their activities. Element sulfur in the amount of 2.0–4.0 wt. % of dry coal was added as sulfiding agent. Table 1 summarized the test results.

TABLE 1

| | Test No. | | | | |
|---|---|---|---|---|---|
| | 49 | 50 | 62 | 65 | 69 |
| Catalyst Precursor | PMA-13 | ADM-13 | AHM-1 | MoDTC | HMoTBA |
| Mo Amount, wt. % on dry coal | 1.0 | 1.0 | 1.0 | 1.0 | 1.0 |
| Temperature, °C. | 427 | 427 | 427 | 427 | 427 |
| Pressure, psig | 2500 | 2500 | 2500 | 2500 | 2500 |
| Reaction Time, min. | 160 | 160 | 160 | 160 | 160 |
| Sulfur, wt. % on dry coal | 2.0 | 2.0 | 2.0 | 2.0 | 2.0 |
| Yields, wt. % on daf coal | | | | | |
| $H_2$ | −5.7 | −5.1 | −5.3 | −6.8 | −6.5 |
| $H_2O$ | 6.7 | 7.1 | 5.6 | 8.3 | 8.1 |
| Chemical Gases | 2.2 | 2.9 | 3.6 | 2.9 | 2.9 |
| $C_1$–$C_4$ | 7.0 | 8.5 | 8.3 | 6.8 | 8.6 |
| $C_5$ | 57.5 | 53.5 | 46.4 | 61.2 | 63.1 |
| DAF Coal Conversion, wt. % | 67.8 | 66.8 | 58.5 | 72.7 | 76.2 |

Note:
PMA-13 = aqueous phosphomolybdic acid solution contains 13.33 wt. % Mo.
ADM-13 = aqueous ammonium dimolybdate solution contains 13.33 wt. % Mo.
AHM-1 = ammonium heptamolybdate impregnated on coal.
MoDTC = dibutyldithiocarbamato molybdenum, added to autoclave as powder.
HMoTBA = tetrabutylammonium hexamolybdate, added to autoclave as powder.
daf and DAF = dry ash free.

Results from Table 1 indicated that the catalyst precursor of tetrabutylammonium hexamolybdate had a substantially higher activity for hydroconversion of coal than other inorganic molybdenum salts or heteropoly acid regardless how they were introduced to the coal slurry. Furthermore, it is quite surprising that tetrabutylammonium hexamolybdate (42.2% Mo) is even more active than dibutyldithiocarbamato molybdenum (17.9% Mo), one of the most active forms of molybdenum precursor for coal liquefaction from previous studies.

EXAMPLE 16

Similar experiments on hydroconversion of Ohio coal at different conditions were carried out in the 380 ml autoclave. Results were summarized in Table 2.

TABLE 2

| | Test No. | | | |
|---|---|---|---|---|
| | 60 | 63 | 66 | 68 |
| Catalyst Precursor | AHM-1 | PAHM-1 | MoDTC | HMoTBA |
| Mo Amount, wt. % on dry coal | 1.0 | 1.0 | 1.0 | 1.0 |
| Temperature, °C. | 438 | 438 | 438 | 438 |
| Pressure, psig | 2500 | 2500 | 2500 | 2500 |
| Reaction Time, min. | 120 | 120 | 120 | 120 |
| Sulfur, wt. % on dry coal | 2.0 | 2.0 | 2.0 | 4.0 |
| Yields, wt. % on daf coal | | | | |
| $H_2$ | −5.1 | −5.7 | −6.2 | −7.0 |
| $H_2O$ | 5.6 | 5.7 | 7.6 | 8.3 |
| Chemical Gases | 3.6 | 3.9 | 3.2 | 3.4 |
| $C_1$–$C_4$ Gases | 9.9 | 10.6 | 6.8 | 12.2 |
| $C_5$ - 540° | 46.8 | 49.3 | 64.3 | 62.7 |
| DAF Coal Conversion, wt. % | 60.8 | 63.8 | 75.6 | 79.7 |

Note:
PAHM-1 = $[NH_4]_4H_2Mo_2P_2O_{23}.xH_2O$ impregnated on coal.

Results of coal liquefaction at 438° C., 2500 psig, and 120 minutes also indicated that tetrabutylammonium hexamolybdate provided higher coal conversion than dibutyldithiocarbamato molybdenum, and tetrabutylammonium hexamolybdate was much superior than ammonium heptamolybdate and its heteropolyacid derivative.

EXAMPLE 17

Activity comparison of various tetraalkylammonium polymolybdates was carried on hydroconversion of Monterey coal in batch autoclave. Results are listed in Table 3 below.

TABLE 3

| | Test No. | | |
|---|---|---|---|
| | 72 | 83 | 84 |
| Catalyst Precursor | HMoTBA | HMoTEA | MIX-TMA |
| Mo Amount, wt. % on dry coal | 1.0 | 1.0 | 1.0 |
| Temperature, °C. | 427 | 427 | 427 |
| Pressure, psig | 2500 | 2500 | 2500 |
| Reaction Time, min. | 160 | 160 | 160 |
| Sulfur, wt. % on dry coal | 2.5 | 2.5 | 2.5 |
| Yields, wt. % of daf coal | | | |
| $H_2$ | −6.9 | −6.6 | −6.2 |
| $H_2O$ | 11.9 | 12.1 | 10.5 |
| Chemical Gases | 4.1 | 3.9 | 4.2 |
| $C_1$–$C_4$ Gases | 8.6 | 9.1 | 12.3 |
| $C_5$ - 540° C. | 61.5 | 61.1 | 55.9 |
| DAF Coal Conversion, wt. % | 79.2 | 79.6 | 76.7 |

Note:
HMoTEA = tetraethylammonium Hexamolybdate.
MIX-TMA = a mixture of tetramethylammonium dimolybdate, tetramethyl ammonium hexamolybdate, and tetramethylammonium octamolybdate.

The catalytic activities of both HMoTBA and HMoTEA were similar in liquefaction of Monterey coal as seen from the Table 3. The activity of MIX-TMA was lower than both HMoTBA and HMoTEA.

EXAMPLE 18

The catalytic activity of tetrabutylammonium hexamolybdate was further tested in batch autoclave on Monterey coal with bottoms recycled concept. Results were compared with previous pilot plant runs using MOLYVAN-A as molybdenum precursor. Results were listed in Table 4 below.

TABLE 4

| | Test No. | | |
|---|---|---|---|
| | 86 | 116–120 | 113–114 |
| Catalyst Precursor | HMoTBA | MOLYVAN-A | MOLYVAN-A |
| Mo Amount, wt. % on dry coal | 1.0 | 5.0 | 10.0 |
| Temperature, ° C. | 427 | 413 | 413 |
| Pressure, psig | 2500 | 2300 | 2300 |
| Reaction Time, min. | 160 | 160 | 160 |
| S/C/B wt. ratio | 1.25/1/0.75 | 1.6/1/0.5 | 1.6/1/0.5 |
| Yields, wt. % of daf coal | | | |
| $H_2$ | −7.4 | −8.4 | −8.6 |
| $H_2O$ | 8.4 | 13.9 | 15.3 |
| Chemical Gases | 4.7 | 8.0 | 7.8 |
| $C_1$–$C_4$ Gases | 11.6 | 10.3 | 11.1 |
| $C_5$ - 540° C. | 73.7 | 68.8 | 66.3 |
| DAF Coal Conversion wt. % | 90.9 | 92.7 | 91.8 |

Note:
MOLYVAN-A = trade name of a commercially available organo-molybdenum compound with Mo content of 29.9 wt. %

The above data showed that the high coal conversion and liquid yields that required 5 or 10 wt. % Mo as MOLYVAN-A were achieved with HMoTBA at a Mo level of 1 wt. % only.

EXAMPLE 19

Liquefaction bottoms (540°+C. materials) using tetrabutylammonium hexamolybdate as catalyst precursor were examined by transmission electron microscopy to see the crystal morphology of molybdenum disulfide. Hairy like molybdenum disulfides with size in 5–20 nm were uniformly distributed in bottoms, and each hairy like molybdenum disulfide was isolated from another with very little stacking observed. Bottoms from the pilot plant runs with 5 wt. % Mo as MOLYVAN-A were also examined. Much larger elongated $MoS_2$ (some of them longer than 100 nm) with several layers' stacking were seen from the transmission electron micrograph.

What is claimed is:

1. A process for converting a naturally occurring solid carbonaceous material to normally liquid products, which process comprises:

(a) forming a mixture comprised of said solid carbonaceous material, a hydrocarbonaceous solvent, a sulfur-containing compound, and at least one catalyst precursor represented by the formula:

$[(C_nH_{2n+1})_4N]_aM_bO_cH_d$, where n=1 to 8, a=2 to 6, b=2 to 12, c=7 to 48, and d=0 to 3, and M is a metal selected from Groups VB and VIB of the Periodic Table of the Elements:

(b) heating said mixture at an effective temperature and pressure to convert the catalyst precursor to the corresponding catalyst;

(c) introducing the mixture into a liquefaction zone operated at liquefaction conditions including a temperature from about 340° to 510° C. and a pressure from about 300 to 3,000 wherein an effluent product is produced;

(d) separating a normally liquid and gaseous product from the effluent product in a first separation zone thereby leaving a bottoms fraction including a gas oil fraction and a spent catalyst fraction;

(e) separating said gas oil from said bottoms fraction in a second separation zone thereby leaving a remaining bottoms fraction which contains said spent catalyst fraction;

(f) separating at least a portion of said spent catalyst fraction from said remaining bottoms fraction in a third separation zone;

(g) recovering said spent catalyst from said spent catalyst fraction; and (h) forming a catalyst precursor by mixing together said spent catalyst with the catalyst precursor of step (a) above.

2. The process of claim 1 wherein the solid carbonaceous material is coal.

3. The process of claim 2 wherein the metal is molybdenum.

4. The process of claim 2 wherein the concentration of catalyst precursor in the slurry is from about 20 to 3,000 wppm, based on active metal, by weight of dry solid carbonaceous material.

5. The process of claim 4 wherein the hydrocarbonaceous solvent of step (a) is a portion of the product stream of the instant process.

6. The process of claim 5 wherein the sulfur-containing compound is elemental sulfur.

7. The process of claim 6 wherein the temperature ranges from about 400° to about 460° C. and the pressure from about 1500 to about 2500 psig.

* * * * *